US007345210B2

(12) United States Patent
Maund et al.

(10) Patent No.: US 7,345,210 B2
(45) Date of Patent: Mar. 18, 2008

(54) BLENDING FOR DENSITY SPECIFICATIONS USING FISCHER-TROPSCH DIESEL FUEL

(75) Inventors: Anthony R. Maund, Lincolnshire (GB); Douglas L. Smith, Katy, TX (US); Keith H. Lawson, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 411 days.

(21) Appl. No.: 10/879,272

(22) Filed: Jun. 29, 2004

(65) Prior Publication Data

US 2005/0288537 A1 Dec. 29, 2005

(51) Int. Cl.
*C10L 1/08* (2006.01)
*C10L 1/04* (2006.01)

(52) U.S. Cl. ..... 585/14; 208/15; 208/950

(58) Field of Classification Search ..... 585/14; 208/15

See application file for complete search history.

(56) References Cited

U.S. PATENT DOCUMENTS

| | | | | |
|---|---|---|---|---|
| 5,730,762 | A | 3/1998 | Murakami et al. | 44/329 |
| 5,792,339 | A | 8/1998 | Russell | 208/15 |
| 5,807,413 | A | 9/1998 | Wittenbrink et al. | 44/451 |
| 5,976,201 | A | 11/1999 | Barry et al. | 44/413 |
| 6,004,361 | A | 12/1999 | Barry et al. | 44/413 |
| 6,056,793 | A | 5/2000 | Suppes | 44/446 |
| 6,150,575 | A | 11/2000 | Angevine et al. | 585/14 |
| 6,162,956 | A | 12/2000 | Berlowitz et al. | |
| 6,180,842 | B1 | 1/2001 | Berlowitz et al. | |
| 6,265,629 | B1 | 7/2001 | Fava et al. | |
| 6,274,029 | B1 | 8/2001 | Wittenbrink et al. | |
| 6,276,675 | B1 | 8/2001 | Shamoon | 269/289 |
| 6,291,732 | B2 | 9/2001 | Hubbard et al. | 585/14 |
| 6,296,757 | B1 | 10/2001 | Wittenbrink et al. | 208/15 |
| 6,299,758 | B1 | 10/2001 | Okazaki et al. | 208/15 |
| 6,309,432 | B1 | 10/2001 | Wittenbrink et al. | 44/436 |
| 6,663,767 | B1 | 12/2003 | Berlowitz et al. | |
| 6,755,961 | B1 | 6/2004 | Berlowitz et al. | |
| 6,833,484 | B2 * | 12/2004 | O'Rear | 585/1 |
| 6,860,909 | B2 * | 3/2005 | Berlowitz et al. | 44/436 |
| 6,933,323 | B2 | 8/2005 | O'Rear et al. | |
| 7,053,254 | B2 | 5/2006 | Miller | |
| 2002/0104779 | A1 | 8/2002 | Connor et al. | 208/15 |

FOREIGN PATENT DOCUMENTS

WO WO 01/81511 A2 1/2001

OTHER PUBLICATIONS

ACEA, Alliance, EMO, JAMA, *World-Wide Fuel Charter*, Dec. 2002.

O'Rear et al "*Thermally Stable Blends of Fischer Tropsch and LCO Diesel Fuel Components*" Energy Fuels, vol. 18(3), pp. 682-684 (May 2004); American Chemical Society Publications-United States; also published on Web on Mar. 25, 2004.

Clark et al "*On-Road Use of Fischer-Tropsch Diesel Blends*", SAE Technical Paper Series 1999-01-2251, pp. 1-8—Society of Automotive Engineers Publications- presented at Government/Industry Meeting on Apr. 27, 1999 in Washington, DC, USA, Session: DOE—Fuels and Lubricants Technologies.

PCT Search Report for International Application PCT/US05/18055 dated Dec. 14, 2006 (2 Pg).

PCT Written Opinion for International Application PCT/US05/18055 dated Dec. 14, 2006 (3 Pg).

PCT International Preliminary Report on Patentability for International Application PCT/US05/18055 dated Feb. 13, 2007 (4 Pg).

* cited by examiner

*Primary Examiner*—Ellen M. McAvoy
(74) *Attorney, Agent, or Firm*—Conley Rose P.C.

(57) ABSTRACT

The present invention includes a method for adjusting a fluid density. In one embodiment, a method for upgrading a petroleum-derived hydrocarbonaceous fraction comprises providing a synthetically-derived hydrocarbonaceous fraction, wherein the synthetically-derived hydrocarbonaceous fraction is derived from synthesis gas, and further wherein the synthetically-derived hydrocarbonaceous fraction and the petroleum-derived hydrocarbonaceous fraction have a difference in density at 15° C. of at least about 60 kg/m$^3$; and blending both fractions so as to form a blend suitable for use as a diesel or diesel blendstock, wherein the blend has a density at 15° C. equal to or more than about 800 kg/m$^3$; alternatively or additionally, equal to or less than about 860 kg/m$^3$. The blending is also effective in reducing the sulfur content of the petroleum-derived hydrocarbonaceous fraction. In preferred embodiments, the synthetically-derived hydrocarbonaceous fraction is a Fischer-Tropsch diesel.

26 Claims, No Drawings

BLENDING FOR DENSITY SPECIFICATIONS USING FISCHER-TROPSCH DIESEL FUEL

BACKGROUND OF THE INVENTION

1. Field of the Invention

This invention relates to the field of Fischer-Tropsch products and more specifically to the field of blending Fischer-Tropsch products with hydrocarbons.

2. Background of the Invention

Natural gas, found in deposits in the earth, is an abundant energy resource. For example, natural gas commonly serves as a fuel for heating, cooking, and power generation, among other things. The process of obtaining natural gas from an earth formation typically includes drilling a well into the formation. Wells that provide natural gas are often remote from locations with a demand for the consumption of the natural gas.

Thus, natural gas is conventionally transported large distances from the wellhead to commercial destinations in pipelines. This transportation presents technological challenges due in part to the large volume occupied by a gas. Because the volume of a gas is so much greater than the volume of a liquid containing the same number of gas molecules, the process of transporting natural gas typically includes chilling and/or pressurizing the natural gas in order to liquefy it. However, this contributes to the final cost of the natural gas and is not economical for formations containing small amounts of natural gas.

Further, naturally occurring sources of crude oil used for liquid fuels such as gasoline and middle distillates have been decreasing and supplies are not expected to meet demand in the coming years. Middle distillates typically include heating oil, jet fuel, diesel fuel, and kerosene. Fuels that are liquid under standard atmospheric conditions have the advantage that in addition to their value, they can be transported more easily in a pipeline than natural gas, since they do not require energy, equipment, and expense required for liquefaction.

Thus, for all of the above-described reasons, there has been interest in developing technologies for converting natural gas to more readily transportable liquid fuels, i.e. to fuels that are liquid at standard temperatures and pressures. One method for converting natural gas to liquid fuels involves two sequential chemical transformations. In the first transformation, natural gas, mixtures of $C_1$-$C_2$ hydrocarbons or methane, the major chemical component of natural gas, is reacted with oxygen, or steam, or carbon dioxide, or any mixture of two or more thereof, to form synthesis gas (also called syngas), which is a combination of carbon monoxide gas and hydrogen gas. The first transformation may comprise steam reforming, auto-thermal reforming, dry reforming, advanced gas heated reforming, partial oxidation, catalytic partial oxidation, combinations thereof, or other processes known in the art. The first transformation to make syngas may be facilitated by a catalyst. Catalyst compositions useful for synthesis gas reactions are well known in the art. They generally are comprised of a catalytic metal selected from Groups 8, 9, and 10 of the Periodic Table (new IUPAC notation) such as noble metals. The catalytic metal may be supported on monoliths, wire mesh and/or particulates of refractory carriers.

The second transformation, known as the Fischer-Tropsch synthesis, generally entails contacting the synthesis gas with a catalyst under temperature and pressure conditions that allow the synthesis gas to react and form hydrocarbons.

More specifically, the Fischer-Tropsch reaction is the catalytic hydrogenation of carbon monoxide to produce any of a variety of products ranging from methane to higher alkanes and aliphatic alcohols. Any Fischer-Tropsch technology and/or methods known in the art will suffice; however, a slurry bubble reactor is preferred. The feed gas charged to the second transformation comprises synthesis gas and optionally an off-gas recycle from the same or another Fischer-Tropsch process. It is preferred that the molar ratio of hydrogen to carbon monoxide in the feed gas be greater than 0.5:1 (e.g., from about 0.67 to about 2.5). The temperature of the second transformation is typically in the range from about 160° C. to about 350° C.

Fischer-Tropsch catalysts are well known in the art and generally comprise a catalytically active metal, a promoter and optionally a support structure. The most common catalytic metals are Group 8, 9 and 10 metals of the Periodic Table (new IUPAC Notation), such as cobalt, nickel, ruthenium, and iron or mixtures thereof. The preferred metals used in Fischer-Tropsch catalysts with respect to the present invention are cobalt, iron and/or ruthenium; however, this invention is not limited to these metals or the Fischer-Tropsch reaction. Other suitable catalytic metals include Groups 8, 9 and 10 metals. The promoters and support material are not critical to the present invention and may be comprised, if at all, by any composition known and used in the art. Promoters suitable for Fischer-Tropsch synthesis may comprise at least one metal from Group 1, 7, 8, 9, 10, 11, and 13. Research continues on the development of more efficient Fischer-Tropsch catalyst systems and reaction systems that increase the selectivity for high-value hydrocarbons in the Fischer-Tropsch product stream.

Typically, the Fischer-Tropsch product stream contains hydrocarbons having a range of numbers of carbon atoms, and thus having a range of molecular weights. The products of the Fischer-Tropsch synthesis may include a large range of molecular weights from light hydrocarbons such as methane to very large molecules with 50 or more carbon atoms. Therefore, the Fischer-Tropsch products produced by conversion of natural gas commonly contain a range of hydrocarbons including gases, liquids and waxes. Depending on the molecular weight product distribution, different Fischer-Tropsch product mixtures are ideally suited to different uses. The Fischer-Tropsch product primarily comprises normal paraffins. It generally has very low contents of heteroatomic impurities such as sulfur-containing compounds, nitrogen-containing compounds or metals. The hydrocarbon product contains practically no aromatics, naphthenes or, more generally, cyclic compounds, in particular when cobalt catalysts are used. While hydrocarbon streams produced via Fischer-Tropsch synthesis may be used in a variety of applications, their use as liquid fuels is of significant interest. In particular, Fischer-Tropsch products are suitable for production of high cetane and low emissions diesel fuels. For example, Fischer-Tropsch product mixtures containing liquids may be processed to yield naphtha, as well as middle distillates. Hydrocarbon waxes may be subjected to an additional processing step (typically a hydrocracking step) for conversion to liquid and/or gaseous hydrocarbons. Thus, in the production of a Fischer-Tropsch product stream for processing to a fuel, it is desirable to obtain primarily hydrocarbons that are liquids and waxes, which are nongaseous hydrocarbons (e.g., $C_{5+}$ hydrocarbons).

Fischer-Tropsch products have also been used to blend with hydrocarbon products. In the hydrocarbon industry, hydrocarbon products may be used as a plurality of fuels.

For instance, hydrocarbons are typically used as diesel fuels. However, to be used as a diesel fuel, the hydrocarbon products typically have specification standards to meet such as industry standards, environmental concerns, government regulations, and the like, which require the hydrocarbon product to have density properties within a certain range. Specification standards may also require that other properties such as sulfur content, aromatics content, boiling point range, and the like be within required ranges. The hydrocarbon products can include refinery product streams such as light cycle oils, vacuum gas oils, heating oils, and the like. These product streams typically have densities that are not within the specification standards for diesel fuels. Therefore, it is highly advantageous to lower the density of these hydrocarbon product streams and thereby increase the potential uses of such refinery product streams for higher-value markets.

Lower density fuels such as kerosene, jet fuel and the like have been used in the past to reduce the density of the hydrocarbon product streams. Jet fuel and kerosene are typically blended with the hydrocarbon product in amounts to bring the hydrocarbon product within a desired density range. The jet fuel and kerosene can be independently blended with the hydrocarbon product stream or can both be blended with the hydrocarbon stream. Drawbacks to blending with the lower density streams include the hydrocarbon product stream having properties that may not be able to satisfy other specification standards. For instance, blending a hydrocarbon product stream with a kerosene may bring the hydrocarbon product stream within density specification standards but not within sulfur or flash point specification standards. Further drawbacks include the cost efficiency of the lower density streams. For instance, lower density fuels such as jet fuel typically have a high market cost in relation to other fuels.

Consequently, there is a need for an improved method for reducing the density of hydrocarbon product streams. In addition, a need exists for a more efficient and effective method for blending hydrocarbon product streams to meet density specifications so as to form upgraded blends, wherein some of these upgraded blends are suitable for use as diesels or diesel blend stocks.

BRIEF SUMMARY OF SOME OF THE PREFERRED EMBODIMENTS

These and other needs in the art are addressed in one embodiment by a method for adjusting a fluid density, the method comprising exposing the fluid to at least one Fischer-Tropsch derived middle distillate; and combining the fluid and the at least one Fischer-Tropsch derived middle distillate to produce a fluid product having an adjusted density.

In another embodiment, the invention provides a method for producing a fluid having an adjusted density, the method comprising: feeding a syngas to a hydrocarbon synthesis reactor, wherein the syngas is reacted to produce a hydrocarbon synthesis product; separating a hydrocarbonaceous fraction from the hydrocarbon synthesis product; and combining the hydrocarbonaceous fraction with the fluid to adjust the density of the fluid.

A further embodiment includes a method for upgrading a petroleum-derived hydrocarbonaceous fraction to a higher value hydrocarbon product. The upgrading preferably includes forming a blend comprising said low-value petroleum-derived hydrocarbonaceous fraction. In preferred embodiments, the blend is suitable for use as a diesel fuel or a diesel blendstock. The method comprises providing the petroleum-derived hydrocarbonaceous fraction; providing a synthetically-derived hydrocarbonaceous fraction, wherein the synthetically-derived hydrocarbonaceous fraction is derived from synthesis gas, and further wherein the synthetically-derived hydrocarbonaceous fraction and the petroleum-derived hydrocarbonaceous fraction have a difference in density at 15° C. of at least about 60 kg/m$^3$; and blending said petroleum-derived hydrocarbonaceous fraction with an effective amount of synthetically-derived hydrocarbonaceous fraction so as to form a blend which is suitable as a diesel fuel or a diesel blendstock, wherein the blend has a density at 15° C. equal to or greater than about 800 kg/m$^3$. In preferred embodiments, the blend has a sulfur content less than about 1,000 ppm, more preferably less than about 500 ppm, still more preferably less than about 300 ppm. In alternative embodiments, the blend has a sulfur content less than 30 ppm sulfur. In additional embodiments, the blend has a density at 15° C. equal to or less than about 860 kg/m$^3$. In yet additional embodiments, the blend has a density at 15° C. equal to or less than about 850 kg/m$^3$. Preferably, the density at 15° C. of the petroleum-derived hydrocarbonaceous fraction is greater than that of the synthetically-derived hydrocarbonaceous fraction.

Some alternative embodiments include the blend having a density at 15° C. equal to or lower than about 860 kg/m$^3$, preferably equal to or less than about 850 kg/m$^3$.

Other alternative embodiments include the synthetically-derived hydrocarbonaceous fraction having a density at 15° C. between about 760 kg/m$^3$ and about 800 kg/m$^3$. In addition, the synthetically-derived hydrocarbonaceous fraction comprises a Fischer-Tropsch diesel.

It will therefore be seen that the technical advantages of this invention include using Fischer-Tropsch diesel to reduce the density of hydrocarbons, thereby eliminating problems encountered by using kerosene and/or jet fuel to reduce the density of hydrocarbons. For instance, jet fuel typically has a high market cost. In addition, jet fuel and kerosene may bring other properties of the hydrocarbons outside of the specification standards.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

DETAILED DESCRIPTION OF THE PREFERRED EMBODIMENTS

The synthetically-derived hydrocarbonaceous fraction preferably includes a middle distillate, such as diesel, kerosene, jet fuel, and the like, but, alternatively or in addition, can include any synthetically-derived hydrocarbonaceous fractions derived from synthesis gas, such as naphtha. Preferably, it comprises at least one fraction selected from among diesel, kerosene, jet fuel, naphtha, and any combination of two or more thereof. More preferably, the synthetically-derived hydrocarbonaceous fraction comprises at least one fraction selected from Fischer-Tropsch derived diesel, Fischer-Tropsch derived kerosene, Fischer-Tropsch derived jet fuel, Fischer-Tropsch derived naphtha, and any combination of two or more thereof. Still more preferably, the synthetically-derived hydrocarbonaceous fraction comprises Fischer-Tropsch derived diesel. Most preferably, the synthetically-derived hydrocarbonaceous fraction is comprised essentially of Fischer-Tropsch derived diesel.

The synthetically-derived hydrocarbonaceous fraction can be combined with a petroleum-derived hydrocarbonaceous fraction by any known method and/or equipment to form the blend. The petroleum material can be any suitable petroleum material. The petroleum material can be extracted from hydrocarbonaceous earth formations such as subterranean (e.g., sedimentary) formations, said hydrocarbonaceous earth formations preferably being solid or liquid under ambient temperature and pressure. The extracted material can be treated and/or separated in order to generate the petroleum-derived hydrocarbonaceous fraction. Preferably, the petroleum-derived hydrocarbonaceous fraction is obtained from crude oil, tar sand, shale oil, coal, and any combination of two or more thereof. A suitable petroleum-derived hydrocarbonaceous fraction is liquid at ambient temperature and pressure. The petroleum-derived hydrocarbonaceous fraction can comprise any suitable crude oil-derived fraction, as can be obtained by the refining of said crude oil. Examples of the refining include distillation or fractionation (atmospheric; vacuum); catalytic cracking (such as FCC); thermal cracking (such as visbreaking); hydrocracking; coking; hydrotreating; and combinations thereof. Preferably, the petroleum-derived hydrocarbonaceous fraction comprises at least one fraction of a diesel, a light cycle oil, a heavy cycle oil, a vacuum gas oil, a heating oil, a bunker fuel, a stove oil, a range oil, a furnace oil, a coker diesel, a hydrotreated visbroken gasoil and any combination of two or more thereof. More preferably, the petroleum-derived hydrocarbonaceous fraction comprises at least one fraction of an off-diesel, a light cycle oil, a heavy cycle oil, a vacuum gas oil, a heating oil, a bunker fuel, a coker diesel and any combination of two or more thereof. In addition, the petroleum-derived hydrocarbonaceous fraction can have any sulfur content less than about 10,000 parts per million of sulfur by weight (ppm S), preferably a sulfur content less than about 1,000 ppm S, more preferably a sulfur content less than about 700 ppm S. In some embodiments, the petroleum-derived hydrocarbonaceous fraction can have a sulfur content of less than about 500 ppm S.

The synthetically-derived hydrocarbonaceous fraction can have a low sulfur content, preferably less than 20 ppm, and more preferably a sulfur content less than about 10 ppm sulfur. In some embodiments, the synthetically-derived hydrocarbonaceous fraction has a sulfur content less than about 5 ppm S. Further, the synthetically-derived hydrocarbonaceous fraction can comprise any cetane number for a syngas-derived hydrocarbon. Preferably, the synthetically-derived hydrocarbonaceous fraction comprises a cetane number equal to or greater than 65, more preferably equal to or greater than 70. In some embodiments, the synthetically-derived hydrocarbonaceous fraction comprises a cetane number equal to or greater than 75. In addition, the synthetically-derived hydrocarbonaceous fraction can comprise any density for a syngas-derived hydrocarbon. Preferably the synthetically-derived hydrocarbonaceous fraction comprises a density at 15° C. between about 760 kg/m$^3$ and about 800 kg/m$^3$, more preferably a density at 15° C. between about 770 kg/m$^3$ and about 790 kg/m$^3$. Moreover, the synthetically-derived hydrocarbonaceous fraction can comprise any boiling range for a syngas-derived hydrocarbon. Preferably, the synthetically-derived hydrocarbonaceous fraction has a boiling range with an initial boiling point between about 130° C. and about 200° C. and a final boiling point between about 300° C. and about 380° C. These boiling points are based on the method ASTM D-86 from the American Society for Testing and Materials. In some embodiments, the synthetically-derived hydrocarbonaceous fraction is characterized by a paraffin content greater than about 90 percent, preferably greater than about 95 percent. In alternate embodiments, the synthetically-derived hydrocarbonaceous fraction preferably has an aromatics content of less than about 1 percent by weight.

The synthetically-derived hydrocarbonaceous fraction and the petroleum-derived hydrocarbonaceous fraction are blended to reduce the density and/or sulfur content of the petroleum-derived hydrocarbonaceous fraction and thereby produce an upgraded hydrocarbon product. Preferably, the upgraded hydrocarbon product has a boiling range with an initial boiling point between about 130° C. and about 200° C. and a final boiling point between about 300° C. and about 380° C. In some embodiments, the upgraded hydrocarbon product has a boiling range with an initial boiling point between about 160° C. and about 200° C. and a final boiling point between about 340° C. and about 380° C. Preferably, the upgraded hydrocarbon product is a diesel. The upgraded hydrocarbon product comprises a density at 15° C. that is equal to or greater than about 800 kg/m$^3$. The upgraded hydrocarbon product comprises a density at 15° C. that is equal to or less than about 860 kg/m$^3$; preferably equal to or less than about 850 kg/m$^3$. More preferably, the upgraded hydrocarbon product comprises a density at 15° C. that is between about 800 kg/m$^3$ and about 850 kg/m$^3$. The upgraded hydrocarbon product also comprises a sulfur content less than about 1,000 ppm sulfur, more preferably less than about 500 ppm sulfur, still more preferably less than about 300 ppm sulfur. In some embodiments, the upgraded hydrocarbon product comprises a sulfur content less than about 30 ppm sulfur. An effective amount of the synthetically-derived hydrocarbonaceous fraction can be blended with the petroleum-derived hydrocarbonaceous fraction so as to produce an upgraded hydrocarbon product suitable for use as diesel or a diesel blendstock.

The synthetically-derived hydrocarbonaceous fraction and the petroleum-derived hydrocarbonaceous fraction preferably have a difference in density at 15° C. of at least about 60 kg/m$^3$, more preferably a difference in density at 15° C. of at least about 65 kg/m$^3$. In some embodiments, the difference in density at 15° C. between the synthetically-derived hydrocarbonaceous fraction and the petroleum-derived hydrocarbonaceous fraction is at least about 70 kg/m$^3$. In some embodiments, the difference in density at 15° C. between the synthetically-derived hydrocarbonaceous fraction and the petroleum-derived hydrocarbonaceous fraction is less than about 220 kg/m$^3$. In other embodiments, the difference in density at 15° C. between the synthetically-derived hydrocarbonaceous fraction and the petroleum-derived hydrocarbonaceous fraction is less than about 200 kg/m$^3$.

In alternative embodiments, the synthetically-derived hydrocarbonaceous fraction can be blended with the petroleum-derived hydrocarbonaceous fraction to reduce its density and/or sulfur content and to adjust at least one other property of the petroleum-derived hydrocarbonaceous fraction, with the other properties including the cetane number, aromatics content, and the like.

The synthetically-derived hydrocarbonaceous fraction can be combined with the petroleum-derived hydrocarbonaceous fraction to reduce the density of the petroleum-derived hydrocarbonaceous fraction for any desired reason. For instance, a petroleum-derived hydrocarbonaceous fraction comprising a coker diesel can be combined with the synthetically-derived hydrocarbonaceous fraction to satisfy density specifications for a diesel fuel. Typically, these specifications determine allowable uses of diesel fuel, classifications of diesel fuel, and the like. Examples of allowable uses of a diesel fuel include on-road use, off-road use, and the like. For instance, regulations may require that the diesel fuel have a density within a specified range to qualify as an on-road use diesel fuel. The regulations may also require the diesel fuel to comprise other properties, such as cetane number, sulfur content, aromatics content, and the like, within a specified range to qualify as the on-road use diesel fuel. An example of classifications for diesel fuels includes specifications for a number 2 diesel fuel. These classifications typically include World-Wide Fuel Charter classifications, ASTM classifications, European classifications, and the like. For instance, the December 2002 World-Wide Fuel Charter recommends a density range of about 820 kg/m$^3$ to about 850 kg/m$^3$, when measured at 15° C., for a number 2 diesel fuel. To bring an off-spec hydrocarbon such as a light cycle oil to within the density specifications of the 2002 World-Wide Fuel Charter specifications for a number 2 diesel fuel, a synthetically-derived hydrocarbonaceous fraction can be combined with the light cycle oil in a desired ratio to bring its density to within 820 kg/m$^3$ to about 850 kg/m$^3$. It is to be noted that the synthetically-derived hydrocarbonaceous fraction may have a density that does not meet the World-Wide Fuel Charter specifications for a diesel. Hence, blending the synthetically-derived hydrocarbonaceous fraction with a petroleum-derived hydrocarbonaceous fraction, both of which have a density not meeting the World-Wide Fuel Charter diesel specifications can result in a blended product that has a density within the acceptable range of density for diesel specifications for example according to the World-Wide Fuel Charter. Furthermore, the petroleum-derived hydrocarbonaceous fraction typically can have a sulfur content that does not meet the World-Wide Fuel Charter specifications for a diesel. Hence, blending the synthetically-derived hydrocarbonaceous fraction (which typically meets the sulfur specifications for diesel) with the petroleum-derived hydrocarbonaceous fraction can result in a blend comprising a sulfur content that meets the World-Wide Fuel Charter diesel specifications.

In alternative embodiments, blending agents can be combined with the blend comprising the synthetically-derived hydrocarbonaceous fraction and the petroleum-derived hydrocarbonaceous fraction. Examples of available blending agents include jet fuel, kerosene, and the like.

In alternative embodiments, one or more additives (such as cetane improver, corrosion inhibitor, pour point depressant, cloud point depressant, smoke suppressor, flow improver, antioxidant, wax anti-settling additive, lubricity enhancer, anti-static agent, de-hazer, detergent, anti-foam agent, biocide, and the like) can be combined with the blend comprising the synthetically-derived hydrocarbonaceous fraction and the petroleum-derived hydrocarbonaceous fraction so as to stabilize the blend and/or such that the blend meets additional specifications such as a cold-flow property, lubricity, corrosion, oxidation, bacterial growth, and the like. The content of these additives are preferably less than 1% of the total blend.

The synthetically-derived hydrocarbonaceous fraction is preferably derived from a mixture of hydrogen ($H_2$) and carbon monoxide (CO). $H_2$/CO mixtures suitable as a feedstock for conversion to hydrocarbon products to generate the synthetically-derived hydrocarbonaceous fraction are preferably obtained from light hydrocarbons, such as a methane-containing gas or any $C_1$-$C_4$ mixtures of hydrocarbon or natural gas, by means of steam reforming, auto-thermal reforming, dry reforming, advanced gas heated reforming, partial oxidation, catalytic partial oxidation, other processes known in the art, or any combination of two syngas processes or more thereof. Alternatively, the $H_2$/CO mixtures (also called biosyngas) can be obtained from biomass. Additionally, $H_2$/CO mixtures can be obtained from coal by gasification. Any combination of these syngas generation methods can produce $H_2$/CO mixtures suitable as syngas feed to the Fischer-Tropsch process. In addition, the syngas feed can comprise off-gas (or tail gas) recycle from the present or another Fischer-Tropsch process. When cobalt, nickel, iron, and/or ruthenium catalysts are used in the Fischer-Tropsch process, the syngas feed contains hydrogen and carbon monoxide in a molar ratio of about 0.67:1 to about 4:1, preferably of about 1.4:1 to about 2.3:1; more preferably of about 1.7:1 to about 2.2:1. The syngas feed is contacted with a Fischer-Tropsch catalyst in a reaction zone. Mechanical arrangements of conventional design may be employed as the reaction zone including, for example, fixed bed, fluidized bed, slurry bubble column or ebullating bed reactors, among others. Accordingly, the preferred size and physical form of the catalyst particles may vary depending on the reactor in which they are to be used. In preferred embodiments, particulate Fischer-Tropsch catalysts comprising cobalt, ruthenium, or combination thereof, are used in the reaction zone. The particulate catalyst more preferably comprises cobalt as catalytic metal. The particulate catalyst most preferably comprises a supported cobalt catalyst. In most preferred embodiments, the hydrocarbon synthesis reactor comprises a slurry bubble column reactor loaded with fresh catalyst particles of a weight average particle size between about 30 microns and 90 microns, wherein said catalyst particles comprise cobalt as a catalytically active metal and optionally one or more promoters. Suitable promoters for Fischer-Tropsch catalysts preferably include ruthenium, rhenium, platinum, palladium, boron, manganese, magnesium, silver, lithium, sodium, copper, potassium, and any combination of two or more thereof. The reduced catalyst may be supported or unsupported. The support for a supported catalyst preferably includes an inorganic oxide such as silica, alumina, titania, zirconia or any combination thereof. Alternatively, hydrocarbon synthesis reactor comprises a fixed bed reactor loaded with catalyst particles of a fresh size greater than about 250 microns, wherein said catalyst particles comprise cobalt or iron as catalytically active metal and optionally one or more promoters.

The hydrocarbon synthesis reactor is typically run in a continuous mode. In this mode, the gas hourly space velocity through the reactor typically may range from about 50 to about 10,000 hr$^{-1}$, preferably from about 300 hr$^{-1}$ to about 2,000 hr$^{-1}$. The reaction zone temperature is typically in the range from about 160° C. to about 300° C. Preferably, the reaction zone is operated at conversion promoting conditions at temperatures from about 190° C. to about 260° C., more preferably from about 205° C. to about 230° C. The reaction zone pressure is typically in the range of about 80 psia (552 kPa) to about 1,000 psia (6,900 kPa), more preferably from 80 psia (550 kPa) to about 800 psia (5,515 kPa), and still more preferably from about 140 psia (965 kPa) to about 750 psia (5,170 kPa). Most preferably, the reaction zone pressure is from about 250 psia (1,720 kPa) to about 650 psia (4,480 kPa). The per-pass CO conversion in the hydrocarbon synthesis reactor is preferably between 30% and 70%, more preferably between 35% and 65%.

The product of hydrocarbon synthesis reactor primarily comprises hydrocarbons. Hydrocarbon synthesis product typically comprises saturated hydrocarbons (paraffins), unsaturated hydrocarbons (olefins), and oxygenates (alcohols, aldehydes, and the like). In some embodiments, hydrocarbon synthesis product primarily comprises paraffins (more than 80% paraffins).

The hydrocarbon synthesis process can also comprise a fractionator in order for the product of hydrocarbon synthesis reactor to be separated into various fractions, including the synthetically-derived hydrocarbonaceous fraction, which may be a naphtha fraction and a middle distillate fraction (including a diesel fraction). Methods of fractionation are well known in the art, and the feed to the fractionator can be separated by any suitable fractionation method. The fractionator preferably includes an atmospheric distillation column.

Hydrocarbon synthesis product in part or in totality is preferably further hydroprocessed in order to generate an acceptable yield of the synthetically-derived hydrocarbonaceous fraction. Hydroprocessing can be accomplished on the totality or a portion of the hydrocarbon synthesis product. Hydroprocessing can comprise hydrotreatment, hydrocracking, hydroisomerization, de-waxing, or any combination thereof. In some embodiments, the hydroprocessing comprises a hydrotreatment to reduce the olefin and oxygenates contents of the synthetically-derived hydrocarbonaceous fraction. The hydrotreatment preferably converts in the presence of hydrogen gas substantially all of the unsaturated hydrocarbons (such as olefins) and oxygenates (such as alcohols) to saturated hydrocarbons (such as alkanes).

Alternatively or in addition, the hydroprocessing may comprise a hydrocracking step to convert heavy hydrocarbons to lighter hydrocarbons. Methods of hydrocracking are well known in the art, and hydrocracking of heavy hydrocarbons (such as wax hydrocarbons) can include any suitable method. Alternatively or in addition, the hydroprocessing may comprise a hydroisomerization step to convert hydrocarbons to more branched hydrocarbons (such as to convert paraffins to isoparaffins), so as to generate a synthetically-derived hydrocarbonaceous fraction with an improved cold-flow property (such as lower pour point). Branched hydrocarbons such as isoparaffins are known to improve cold flow properties of diesel fuel, so increasing the relative amount of branched hydrocarbons in the synthetically-derived hydrocarbonaceous fraction can yield a blend with decreased (improved) pour point.

The method for upgrading a petroleum-derived hydrocarbonaceous fraction may further comprise feeding a hydrocarbon synthesis product to a hydroprocessing unit, wherein the hydrocarbon synthesis product is hydroprocessed to produce a hydroprocessed product; fractionating the hydroprocessed product to at least produce the synthetically-derived hydrocarbonaceous fraction; and combining the synthetically-derived hydrocarbonaceous fraction with the petroleum-derived hydrocarbonaceous fraction to generate the blend.

To further illustrate various illustrative embodiments of the present invention, the following examples are provided.

EXAMPLE 1

European density standards for a number 2 diesel require a density of from about 820 kg/m$^3$ to about 845 kg/m$^3$. To bring a heating oil with a density of about 860 kg/m$^3$ to within the European density standards, Fischer-Tropsch diesel fuel with a density of 780 kg/m$^3$ can be blended with the heating oil. The resulting hydrocarbon product can have a weight percent of about 81.0 percent heating oil and 19.0 percent Fischer-Tropsch diesel fuel, with a density of 845 kg/m$^3$.

EXAMPLE 2

To bring a heating oil with a density of 875 kg/m$^3$ to within the European density standards, Fischer-Tropsch diesel fuel with a density of 780 kg/m$^3$ can be blended with the heating oil. The resulting hydrocarbon can have a weight percent of about 68.0 percent heating oil and 32.0 percent Fischer-Tropsch diesel fuel, with a density of 845 kg/m$^3$.

EXAMPLE 3

A marine bunker fuel with a density of 876 kg/m$^3$ can be blended with a Fischer-Tropsch diesel fuel with a density of 780 kg/m$^3$ at a volume ratio of 30:70. The resultant hydrocarbon can have a density of 848 kg/m$^3$.

It will be understood that the present invention is not limited to the above-identified steps and/or equipment for producing synthetically-derived hydrocarbonaceous fraction and blending it with the petroleum-derived hydrocarbonaceous fraction but can include any suitable combination of such steps and/or equipment as well as any additional steps and/or equipment suitable for producing synthetically-derived hydrocarbonaceous fraction and/or blending it to reduce the density of the petroleum-derived hydrocarbonaceous fraction. The invention is also not limited to combining synthetically-derived hydrocarbonaceous fraction with the petroleum-derived hydrocarbonaceous fraction to reduce the density and/or sulfur content of the petroleum-derived hydrocarbonaceous fraction but also includes alternative embodiments in which the petroleum-derived hydrocarbonaceous fraction has a lower density than synthetically-derived hydrocarbonaceous fraction, and wherein the synthetically-derived hydrocarbonaceous fraction is combined with the petroleum-derived hydrocarbonaceous fraction to increase the density of the petroleum-derived hydrocarbonaceous fraction.

Although the present invention and its advantages have been described in detail, it should be understood that various changes, substitutions and alterations may be made herein without departing from the spirit and scope of the invention as defined by the appended claims.

The invention claimed is:

1. A method for upgrading a petroleum-derived hydrocarbonaceous fraction by at least reducing its density, comprising:

(A) providing the petroleum-derived hydrocarbonaceous fraction comprising a light cycle oil, a heavy cycle oil, a bunker fuel, a vacuum gas oil, a heating oil, or any combination of two or more thereof;

(B) providing a synthetically-derived hydrocarbonaceous fraction, wherein the synthetically-derived hydrocarbonaceous fraction is derived from synthesis gas and has been hydrotreated to convert substantially all of its unsaturated hydrocarbons and oxygenates to saturated hydrocarbons, and further wherein the petroleum-derived hydrocarbonaceous fraction has a density at 15° C. of at least about 60 kg/m$^3$ higher than that of the synthetically-derived hydrocarbonaceous fraction; and (C) blending said petroleum-derived hydrocarbonaceous fraction with an effective amount of synthetically-derived hydrocarbonaceous fraction to reduce the density of said petroleum-derived hydrocarbonaceous fraction to form a blend suitable for use as a diesel or diesel blendstock, wherein the blend has a density at 15° C. between about 800 kg/m$^3$ and about 860 kg/m$^3$.

2. The method of claim 1, wherein the petroleum-derived hydrocarbonaceous fraction has a sulfur content less than 10,000 ppm sulfur.

3. The method of claim 1, wherein the petroleum-derived hydrocarbonaceous fraction has a sulfur content less than about 1,000 ppm sulfur.

4. The method of claim 1, wherein the petroleum-derived hydrocarbonaceous fraction has a sulfur content less than about 700 ppm sulfur.

5. The method of claim 1, wherein the blend has a sulfur content less than about 1,000 ppm.

6. The method of claim 1, wherein the blend has a sulfur content less than about 500 ppm.

7. The method of claim 1, wherein the blend has a sulfur content less than about 300 ppm.

8. The method of claim 1, wherein the petroleum-derived hydrocarbonaceous fraction comprises a bunker fuel, a heating oil, or any combination thereof.

9. The method of claim 1, wherein the petroleum-derived hydrocarbonaceous fraction is derived from a hydrocarbonaceous earth formation selected from the group consisting of crude oil, tar sand, shale oil, coal, and any combination of two of more thereof.

10. The method of claim 9, wherein the petroleum-derived hydrocarbonaceous fraction is derived from refining a crude oil.

11. The method of claim 1, wherein the synthetically-derived hydrocarbonaceous fraction comprises at least one fraction selected from the group consisting of diesel, kerosene, jet fuel, naphtha, and any combination of two or more thereof.

12. The method of claim 1, wherein the blend has a density at 15° C. between about 800 kg/m$^3$ and about 850 kg/m$^3$.

13. The method of claim 1, wherein the blend has a sulfur content less than about 30 ppm sulfur.

14. The method of claim 1, wherein the synthetically-derived hydrocarbonaceous fraction has a density at 15° C. between about 760 kg/m$^3$ and about 800 kg/m$^3$.

15. The method of claim 1, wherein the synthetically-derived hydrocarbonaceous fraction has a density at 15° C. between about 770 kg/m$^3$ and about 790 kg/m$^3$.

16. The method of claim 1, wherein the synthetically-derived hydrocarbonaceous fraction has a sulfur content less than 20 ppm sulfur.

17. The method of claim 1, wherein the synthetically-derived hydrocarbonaceous fraction has a sulfur content less than 10 ppm sulfur.

18. The method of claim 1, wherein the synthetically-derived hydrocarbonaceous fraction has a cetane number equal to or greater than 65.

19. The method of claim 1, wherein the synthetically-derived hydrocarbonaceous fraction has a cetane number equal to or greater than 70.

20. The method of claim 1, wherein the synthetically-derived hydro carbonaceous fraction has a boiling range with an initial boiling point between about 130° C. and about 200° C. and a final boiling point between about 300° C. and about 380° C.

21. The method of claim 1, wherein the synthetically-derived hydrocarbonaceous fraction and the petroleum-derived hydrocarbonaceous fraction have a difference in density at 15° C. of at least about 65 kg/m$^3$.

22. The method of claim 1, wherein the synthetically-derived hydrocarbonaceous fraction and the petroleum-derived hydrocarbonaceous fraction have a difference in density at 15° C. of at least about 70 kg/m$^3$.

23. A method for upgrading a petroleum-derived hydrocarbonaceous fraction to a diesel or diesel blendstock, comprising:

(A) providing the petroleum-derived hydrocarbonaceous fraction comprising a bunker fuel, a heating oil, or any combinations thereof;

(B) providing a synthetically-derived diesel fraction having a density at 15° C. between about 760 kg/m$^3$ and about 800 kg/m$^3$, wherein the synthetically-derived diesel fraction is derived from synthesis gas and has been hydrotreated to convert substantially all of its unsaturated hydrocarbons and oxygenates to saturated hydrocarbons, and further wherein the petroleum-derived hydrocarbonaceous fraction has a density at 15° C. of at least about 60 kg/m$^3$ higher than the density at 15° C. of the synthetically-derived diesel fraction; and (C) blending said petroleum-derived hydrocarbonaceous fraction with an effective amount of synthetically-derived diesel fraction to reduce the density of said petroleum-derived hydrocarbonaceous fraction to form a blend suitable for use as a diesel or diesel blendstock, wherein the blend has a density at 15° C. between about 800 kg/m$^3$ and between about 860 kg/m$^3$.

24. The method of claim 23, wherein the blend has a density at 15° C. between about 800 kg/m$^3$ and between about 850 kg/m$^3$.

25. A method for upgrading a petroleum-derived hydrocarbonaceous fraction to an on-road diesel or diesel blendstock, comprising:

(A) providing a petroleum-derived hydrocarbonaceous fraction which does not qualify as an on-road diesel fuel, wherein the petroleum-derived hydrocarbonaceous fraction has a density at 15° C. of about 860 kg/m$^3$ or higher;

(B) providing a synthetically-derived diesel fraction having a density at 15° C. between about 760 kg/m$^3$ and about 800 kg/m$^3$, wherein the synthetically-derived hydrocarbonaceous diesel fraction is derived from synthesis gas and has been hydrotreated to convert substantially all of its unsaturated hydrocarbons and oxygenates to saturated hydrocarbons; and (C) blending said petroleum-derived hydrocarbonaceous fraction with an effective amount of synthetically-derived diesel fraction to reduce the density of said petroleum-derived hydrocarbonaceous fraction to form a blend suitable for use as an on-road diesel or diesel blendstock, wherein the blend has a density at 15° C. between about 800 kg/m$^3$ and between about 860 kg/m$^3$.

26. The method of claim 25, wherein said petroleum-derived hydrocarbonaceous fraction is a bunker fuel or a heating oil, and further wherein the blend has a density at 15° C. between about 820 and about 845 kg/m$^3$.

* * * * *